United States Patent [19]

Jurek

[11] Patent Number: 4,617,749

[45] Date of Patent: Oct. 21, 1986

[54] .22 CALIBER RIMFIRE ADAPTER SYSTEM FOR M16 TYPE RIFLE

[76] Inventor: Julius V. Jurek, 2046A Corsair Dr., Bethel Manor, Langley AFB, Va. 23665

[21] Appl. No.: 840,470

[22] Filed: Oct. 7, 1977

Related U.S. Application Data

[63] Continuation of Ser. No. 720,468, Sep. 3, 1976, abandoned.

[51] Int. Cl.[4] ..... F41C 11/00

[52] U.S. Cl. ..... 42/16

[58] Field of Search ..... 42/16, 49 A

[56] References Cited

U.S. PATENT DOCUMENTS

| | | | |
|---|---|---|---|
| 3,771,415 | 11/1973 | Into et al. | 42/16 |
| 3,776,095 | 12/1973 | Atchisson | 42/16 |
| 4,008,537 | 2/1977 | Elbe | 42/16 |
| 4,058,922 | 11/1977 | Elbe et al. | 42/16 |
| 4,098,016 | 7/1978 | Foote | 42/16 |
| 4,169,329 | 10/1979 | Atchisson | 42/16 |

FOREIGN PATENT DOCUMENTS

| | | | |
|---|---|---|---|
| 1166052 | 3/1964 | Fed. Rep. of Germany | 42/49 A |

OTHER PUBLICATIONS

Askins, Charles; ".22 Rimfire Conversion for the AR-15"; *Guns;* Nov. 1974; pp. 32, 33, 50, and 51.

U.S. Armament Corporation Unsolicited Proposal for .22 Rim Fire Adapter, May 26, 1977.

*Primary Examiner*—Charles T. Jordan

*Attorney, Agent, or Firm*—Thomas L. Kundert; Donald J. Singer

[57] ABSTRACT

A unitary bolt and chamber adapter for field replacement, without tools, of the conventional bolt assembly of rifles of the type M16 and AR-15 provides for the use of conventional .22 caliber long rifle rimfire ammunition in the rifle instead of the larger conventional centerfire ammunition. The bolt functions in semiautomatic fire by conventional blowback action. Through cooperation with an improved .22 caliber rimfire magazine adapter, the breech automatically remains open after firing the last round from the magazine. The bolt guide rails are flexibly attached to the chamber providing for reliable operation in a larger number of rifles. A spring actuated forward locator on the bolt assembly keeps the adapter seated in the rifle chamber, compensating for differences in gun receiver lengths. An undercut bolt face provides the positive extraction of a double extractor system with a single extractor, and a groove-and-land chamber adapter provides reliable operation with good and poor quality ammunition. A gas diverter protects the rifleman's eyes and provides a clean receiver without modifying the original gun.

15 Claims, 32 Drawing Figures

.22 CALIBER RIMFIRE ADAPTER SYSTEM FOR M16 TYPE RIFLE

RIGHTS OF THE GOVERNMENT

The invention described herein may be manufactured and used by or for the Government of the United States for all governmental purposes without the payment of any royalty.

CROSS-REFERENCE TO RELATED APPLICATIONS

This is a continuation of application Ser. No. 720,468, filed Sept. 3, 1976, now abandoned.

BACKGROUND OF THE INVENTION

The field of the invention is in the art of firearms and more particularly in the art of adapters to provide for the firing of conventional low power ammunition in a gun originally designed for higher power cartridges.

The economic and psychological advantages of training, practicing, and the taking of small game with low power ammunition in a gun conventionally designed for higher power ammunition is well recognized. Adapter "cartridges", sometimes called auxilliary cartridges, for containing the low power round and fitting the chamber of the high power gun have been known since before the turn of the century. A conversion adapter for the Government model .45 caliber ACP converting it to fire .22 caliber rimfire cartridges has been available since prior to World War II. That conversion required a new barrel since the calibers of the bullets were different. The invention disclosed herein does not require any change of barrels since the bullet diameters of the original high power cartridge and the conversion low power cartridge are substantially the same.

Typical examples of modern prior art devices are exemplified by U.S. Pat. No. 3,771,415 to patentees Into and Costello, and U.S. Pat. No. 3,776,095 to patentee Atchisson. A review entitled "AR-15 Rimfire Conversion", by the Technical Staff of the National Rifle Association appearing in the American Rifleman for May 1973 commencing at page 63, is pertinent and informative of problems in the prior art devices.

SUMMARY OF THE INVENTION

The invention is an improved, highly reliable, universally fitting, adapter system for a high power .22 caliber rifle providing for the firing of conventional, economical, .22 caliber, rimfire ammunition. The malfunction rate is greatly improved (reduced) over the prior art devices, by having the adapter chamber land-and-grooved ahead of the .22 caliber rimfire chamber in the gun chamber adapter and by an improved extraction system. A unique gas diverter protects the rifleman's eyes and keeps the action clean providing for the firing of a greater number of rounds between cleaning, and a unique double spring operated bolt catch actuating mechanism in the .22 caliber rimfire adapter magazine maintains the breech open after firing the last round from the magazine adapter.

DESCRIPTION OF THE PREFERRED EMBODIMENTS

Figure 1:
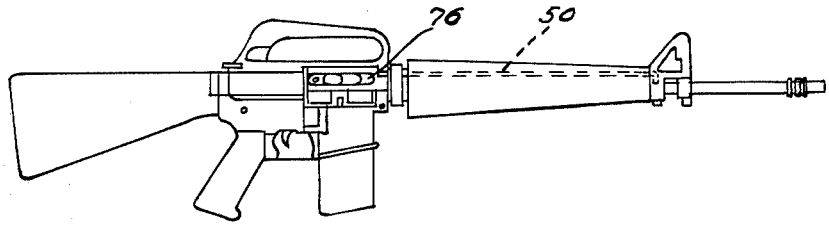
Fig-1 PRIOR ART
FIG. 1 illustrates a typical prior art high power .22 caliber rifle such as the M16 and AR-15.

FIG. 1 illustrates a typical rifle of the military type M16 and the commercial type AR-15. This rifle has a nominal .22 caliber bore. Many guns are of .22 caliber, with chambering ranging from the very small and very low power rimfire .22 caliber CB and BB caps to the ultra high power cartridges such as the .220 Swift and the .22-250 cartridges. The most common and widely manufactured .22 caliber ammunition is the rimfire cartridges commonly known as the 22 short, the 22 long, and the 22 long rifle cartridges. The 22 long rifle cartridge is a highly developed cartridge that is economical, readily available, and a very accurate cartridge that is used in official target matches throughout the world including the Olympics.

The device of the invention adapts the conventional M16, AR-15 and similar types of rifles, conventionally chambered for .22 caliber cartridges such as the .223 cartridge, a relatively high power .22 caliber cartridge, to fire in semiautomatic mode .22 caliber rimfire long rifle ammunition. In the training of an individual in a typical standard military training course this represents a $1.50 ammunition expense compared to a $13.50 ammunition expense, a 9 to 1 monetary saving in ammunition. The typical conventional rifle as shown in FIG. 1 has a bolt that is gas operated by diverting gas pressure from the barrel through gas tube 50 back to the action in the receiver to operate the bolt. In embodiments of the invention the new adapter bolt operates by conventional "blow-back" action only. The small amount of gas from the low power round coming back down tube 50 has expanded, due to the volume of the tube, to the extent that its pressure is insignificant. However, there is sufficient gas flow down the tube to bring burnt powder particles and other gaseous residues back into the action. Some prior art adapters have ignored this material with the consequences of a dirty unreliable action after the firing of a relative few rounds. Other prior art systems have required the modification of the standard arm by the sealing off or closing of the gas tube. This prohibits the field installation of the conversion adapter and the field reconversion to the standard arm. In the following discussion of the operation of the adapter reference should be made to FIGS. 2 through 17.

Figure 2:
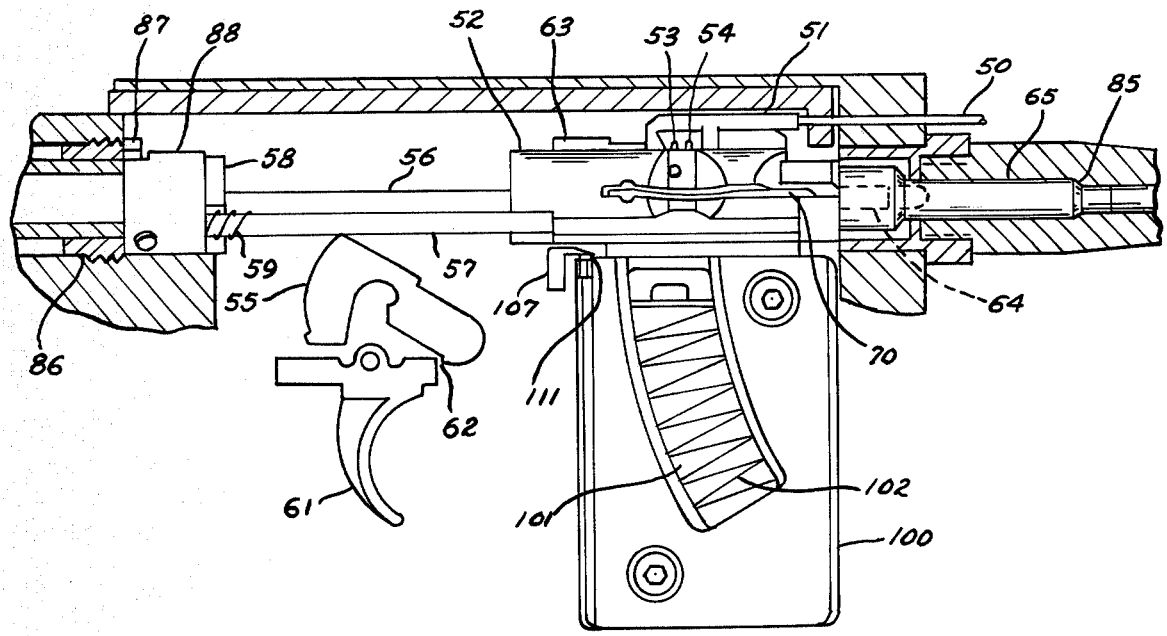
FIG. 2 illustrates, schematically, a side elevational view, partly in cross section, of an embodiment of the adapter system of the invention positioned in a rifle with the bolt in battery position and the hammer cocked.
Figure 7:
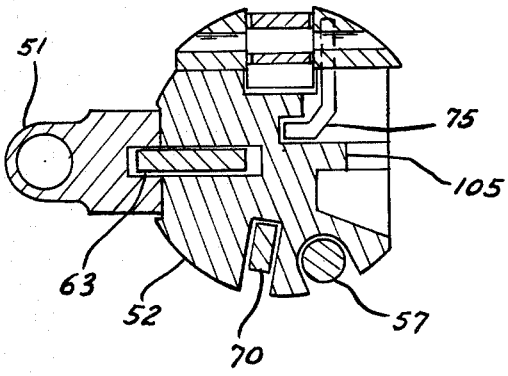
FIG. 7 is a section taken through the bolt of FIG. 6.
Figure 8:
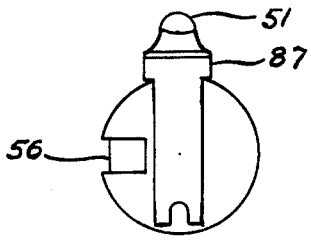
FIG. 8 is a left end view of FIG. 4.

The gas diverter 51 on the adapter engages and surrounds the end of gas tube 50 when bolt 52 is in the battery position, as shown in FIG. 2. Gaseous and burned powder residues from the firing of a round of ammunition coming down gas tube 50 travel through gas diverter 51 and are expelled through ports 53 and 54 out of the action and exterior to the mechanism in a transverse downward direction. This expulsion of gas occurs in the operation of the action before the bolt has moved back sufficiently to disengage or uncover the end of gas tube 50.

Figure 3:
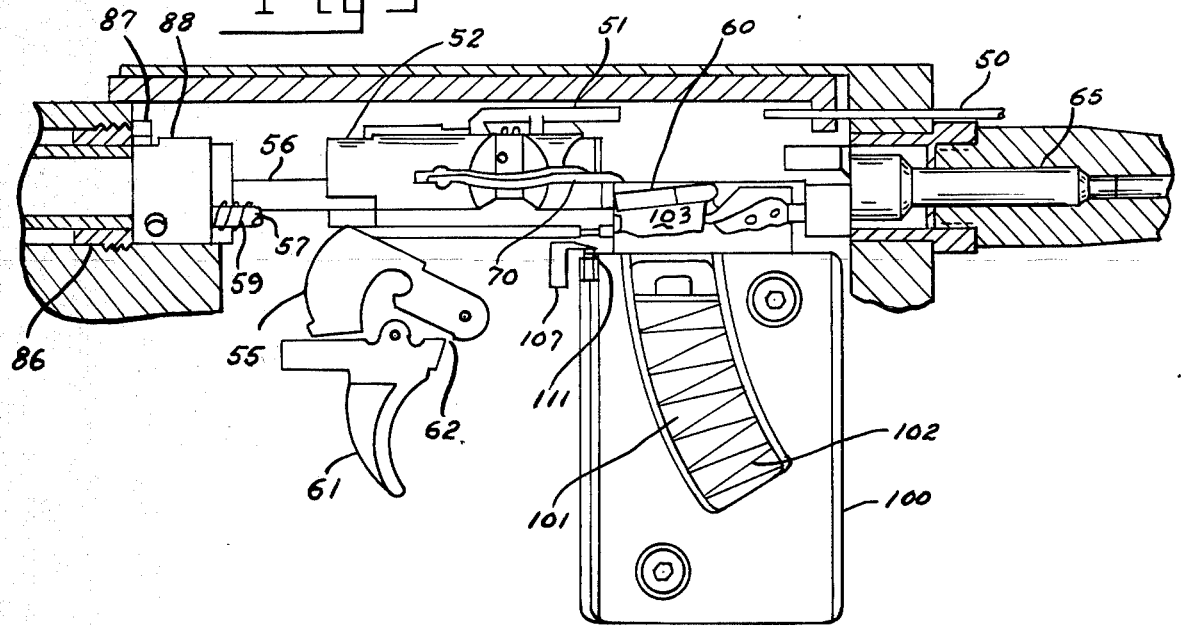
FIG. 3 represents the same action and gun of FIG. 2 except the bolt is at the feed position.

Hammer 55 is cocked by the sliding rearward travel of bolt 52 on the guide rails. With good ammunition bolt 52 slides rearwardly on guide rails 56 and 57, cocking hammer 55, and then striking buffer 58, which absorbs the remaining energy in the bolt with a minimum of shock to the mechanism. Typical buffer material is polyurethane rubber having a Shore A Durometer of approximately 95. Guide rail 57 is a round rod contained within and supporting action spring 59. Action spring 59 then returns bolt 52 to the battery position picking up a new round of ammunition 60 as illustrated in FIG. 3. Upon squeezing trigger 61 with the bolt in the battery position, as shown in FIG. 2, hammer 55 is released from sear notch 62 and by the force of the hammer spring (not shown) the hammer striking inertia firing pin 63 firing new round 64 in chamber adapter 65.

Upon firing a round the spent rimfire case, after initial movement, is withdrawn from the rimfire chamber within gun chamber adapter 65 by conventional spring loaded extractor lever 70 cooperating with undercut recess 71 in the case rim retainer on bolt face 72. (See FIGS. 10 and 11.) It has been found that an optimum angle 73 of undercut measured from perpendicular 74 to bolt face 72 is approximately twenty degrees, with a variation of approximately plus or minus two degrees still providing suitable operation. The depth of the recess in the bolt face receiving the case rim, is the conventional value of nominal cartridge rim thickness. As bolt 52 travels rearward by blowback action the spent case is withdrawn from the chamber and held on the bolt face by extractor 70 and recessed rim retainer 71 until the rim of the case strikes ejector 75, mounted on guide rail 56, which ejects the spent case out ejection port 76 (FIG. 1) of the gun. It is to be observed that bolt 52 cocks hammer 55 before reaching the feed position, thus a live round cannot be chambered without cocking the gun.

As previously stated, adaptors for these type guns are currently available. The primary purpose and object of this invention is to provide an improved adaptor that will reliably function (i.e., to accurately fire in conventional semiautomatic mode) in a larger percentage of guns, compensating within the adapter itself for wide variations in manufacturing tolerances and gun design dimensions, and an adapter that is not sensitive to wide variations in ammunition, both good and poor ammunition in both high speed and regular velocities. Poor ammunition not only includes poorly manufactured ammunition such as ammunition with wide variations in the amount of bullet crimp but ammunition that has been abused in storage by detrimental environmental changes to the extent that the primer or the powder or both have changed characteristics, or the bullet through excessive oxidation has loosened in the case.

Using a typical embodiment of the invention and a particular batch of typically poor ammunition, the malfunction rate was consistently around ½ percent. With currently available prior art adapters and ammunition from the same batch the malfunction rate varied from 4 to 8 percent.

Through a unique cooperation of a combination of unique modifications and structural innovations a greatly improved adapter system is hereby disclosed. The providing of gas diverter structure 51 for safety and to keep the action clean and extend periods of operation between cleaning, has been discussed. For accurate and reliable operation it is required that adapter chamber 65 be firmly positioned and seated in the chamber of the gun. In many guns the chamber in the barrel is not in perfect alignment with the direction of travel of the adapter bolt. With prior art adapter devices, this has frequently prohibited their usage in certain guns and greatly decreased their reliability of operation in others with satisfactory operation being obtained in a "good" gun with "good" ammunition. In these prior art devices, the chamber adapter, and the rear retainer have been rigidly attached to one or both the bolt guide rails. In this invention chamber adapter 65 is loosely pinned to guide rail 56 by one pin only through hole 80. The pin is a loose fit in rail 56 and the rail is likewise a loose fit in notch 78 of chamber adapter 65. (See particularly FIG. 13.) Guide rod 57 also is a loose fit in hole 81, has a rounded end 82, and extends only a little more than halfway through hole 81 (see FIG. 4). This provides a chamber adapter 65 that can swing approximately up to plus and minus five degrees 98 in the horizontal direction, a plane approximately containing guide rail 56 and rod 57, and approximately up to plus and minus two degrees 83 in the vertical direction. This flexibility of the slidable movement of the bolt with the chamber alignment greatly increases the number of guns that the adapter will fit and properly function therein.

Figure 4:
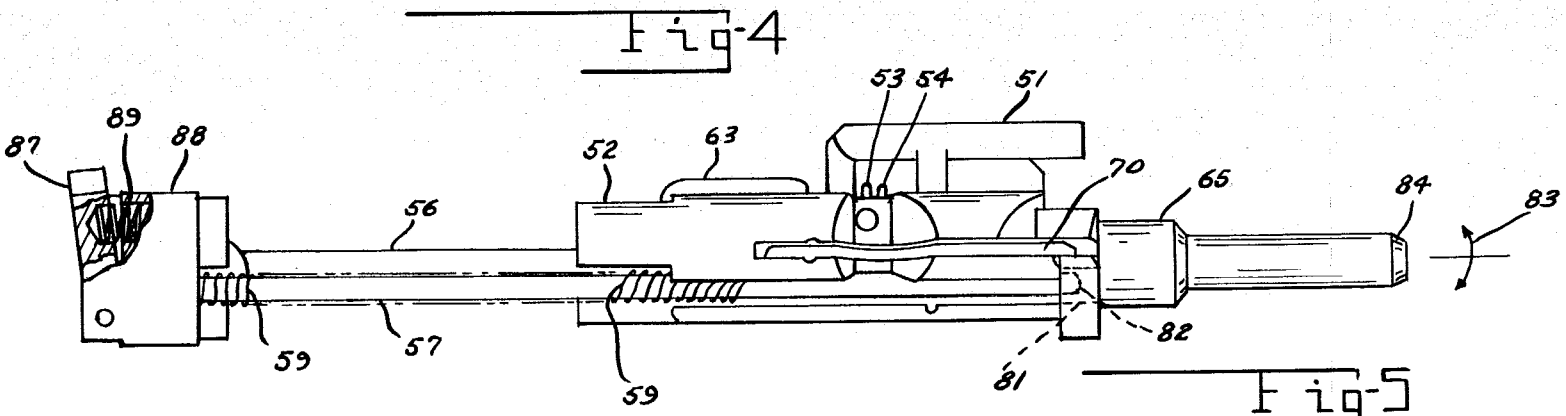
FIG. 4 is a representative view of an embodiment of the unitary slidable bolt and chamber adapter assembly of the invention.
Figure 5:
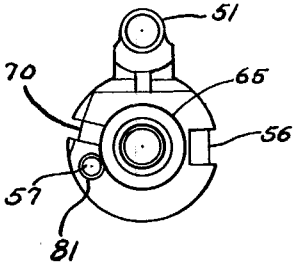
FIG. 5 is a right end view of FIG. 4.
Figure 6:
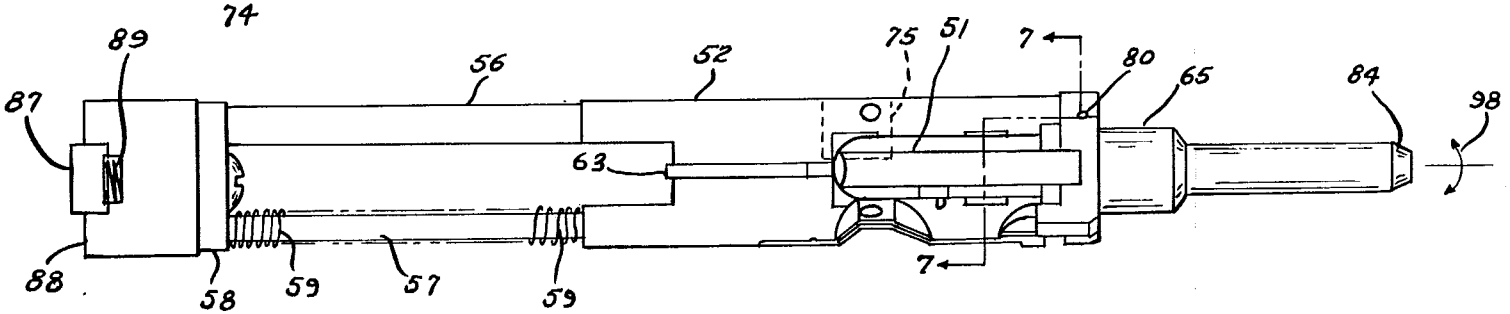
FIG. 6 is a top view of FIG. 4.

It is important that the chamber adapter be firmly seated and positioned in the chamber of the gun so as to effect a substantially gas tight seal between taper 84 of the adapter chamber and shoulder 85 in the chamber of the barrel. The flexible mounting of the adapter chamber on the guide rail and rod helps accomplish this in poorly aligned guns. However, the length of the receivers of the guns also vary due to necessary manufacturing tolerances. Therefore, the distance from chamber shoulder 85 (FIG. 2) in the gun barrel (on which adapter taper 84, FIG. 4, seats) and lower receiver extension socket 86, through which recoil is taken in conventional M16 operation, and on which forward locator 87 of rear retainer 88 bears, may vary considerably between different guns and different guns of different manufacture. Forward locator 87 is spring loaded by spring 89, as illustrated in FIG. 4. Thus, even though receiver lengths between various guns may vary as much as eighty thousandths of an inch, taper 84 of the adapter chamber is always firmly seated and maintained in sealing relationship with chamber shoulder 85 in the rifle barrel. This firm positioning of the adapter mechanism in all guns is also very important for proper relationship between the feed ramp 118 within the lips 104 of the magazine and feed ramp 119 in chamber adapter 65 to prevent malfunctioning and jamming of the round during feeding. This is automatically accomplished with the insertion of the adapter in the gun without any manual adjustment or fitting. This spring loading of the adapter mechanism coupled with the flexible connection of the adapter chamber provides a universal mounting of the adapter of this invention such that proper operation is obtained in many more weapons than could be obtained with prior art devices. Some of the prior art adapters have a neck on the adapter chamber. I have found the necessarily thin walled neck to be an unnecessary complication, greatly adding to the fragility of the adapter, and in some instances it is detrimental to obtaining a seal between the taper of the adapter and the shoulder of the chamber.

Figure 10:
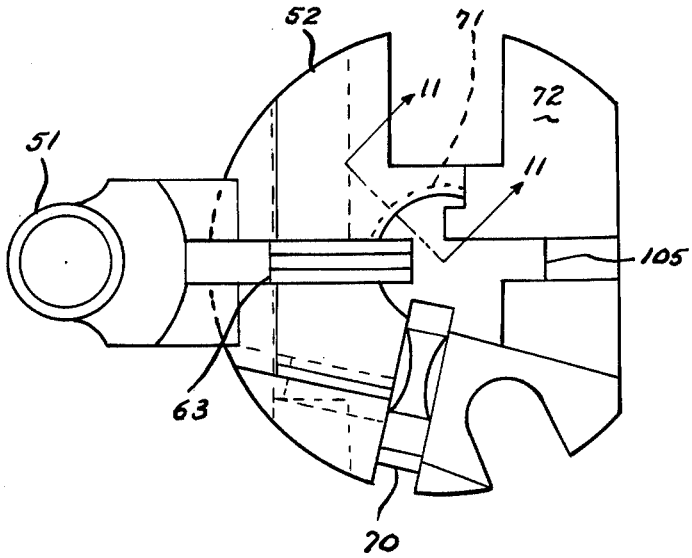
FIG. 10 is a right end view of FIG. 9 showing the bolt face.
Figure 11:
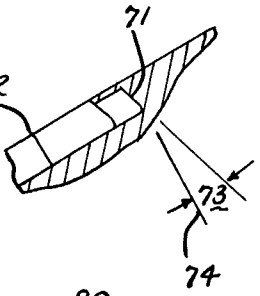
FIG. 11 is a partial section of the bolt face of FIG. 10 showing the undercut cartridge rim retainer.
Figure 9:
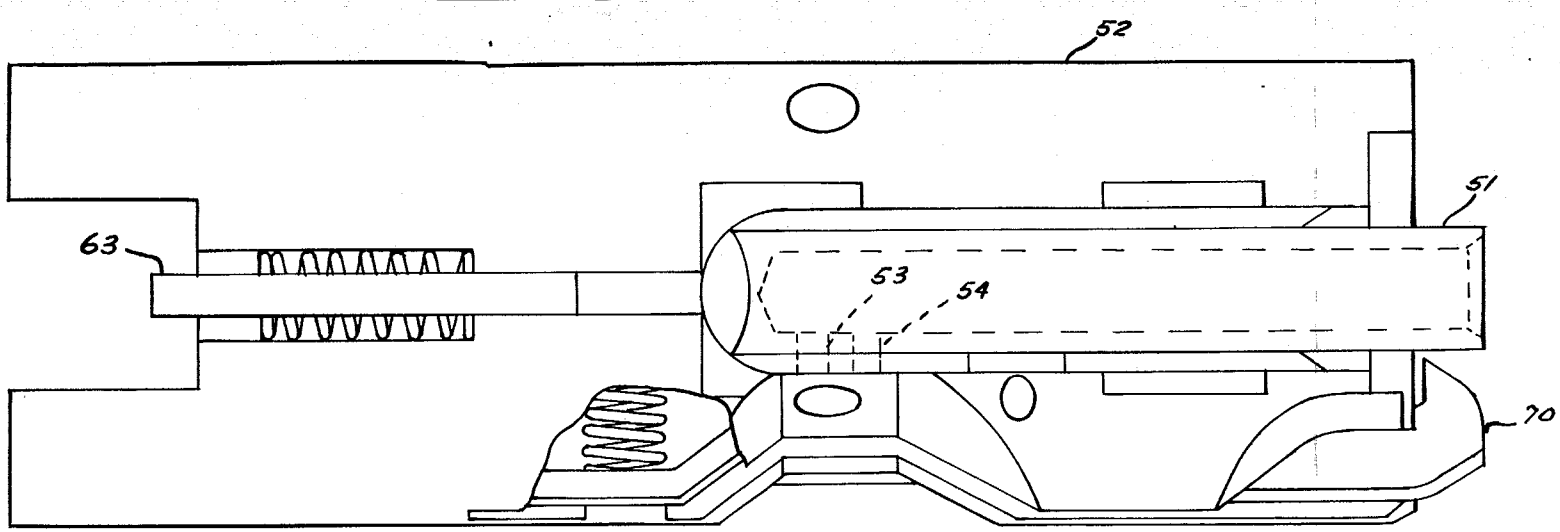
FIG. 9 is an enlarged view of an embodiment of a typical bolt assembly.
Figure 13:
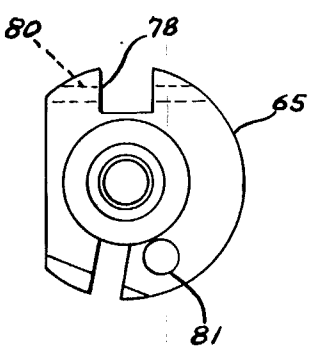
FIG. 13 is a right end view of the chamber adapter illustrated in FIG. 12.
Figure 12:
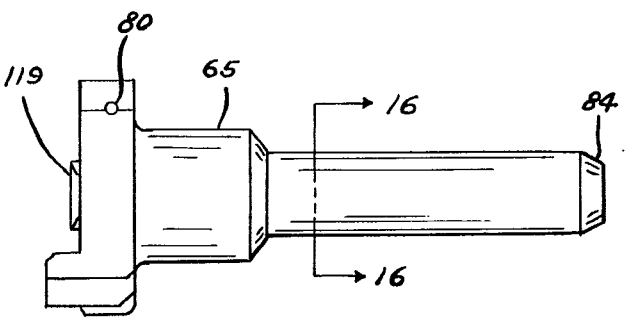
FIG. 12 is an enlarged view of the chamber adapter shown in FIGS. 4 and 6.
Figure 14:
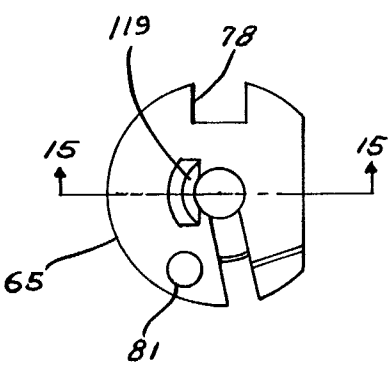
FIG. 14 is a left end view of the chamber adapter illustrated in FIG. 12.

Some small arms have bolts with double lever arm extractors to provide a more reliable operating arm than those having but a single hooked lever arm extractor. The conventional single extractor bolt has a conventional straight walled cartridge rim receiving recess in its face in which the cartridge rim rests. In conventional single lever case extraction, occasionally the case slips out from under the extractor hook and a jam results. This is conventionally remedied by having two extractor arms placed substantially opposite each other across the case, each extractor gripping the rim of the case. Double extractors are expensive and provide additional complications in case ejection. I have found that substantially the reliability of double lever extraction may be obtained with a single extractor lever arm by providing an undercut 71 in approximately a 90° segment of the case rim retainer approximately opposite the hooked extractor lever arm 70 as shown in FIGS. 10 and 11, and as previously explained in connection with the operation of the bolt.

Figure 15:
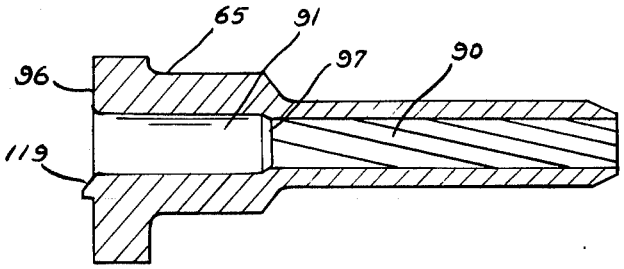
FIG. 15 is a longitudinal section view through the chamber adapter as shown in FIG. 14.
Figure 16:
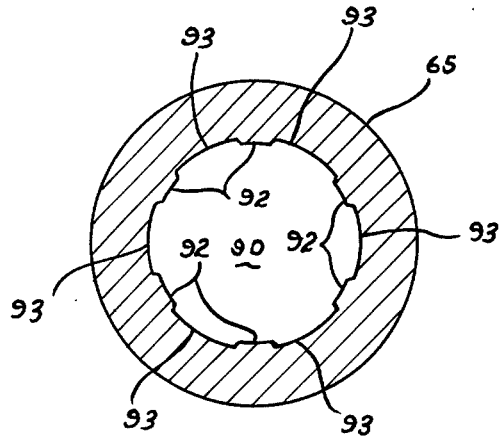
FIG. 16 is a transverse section through the chamber adapter shown in FIG. 12 illustrating the lands and grooves.
Figure 17:
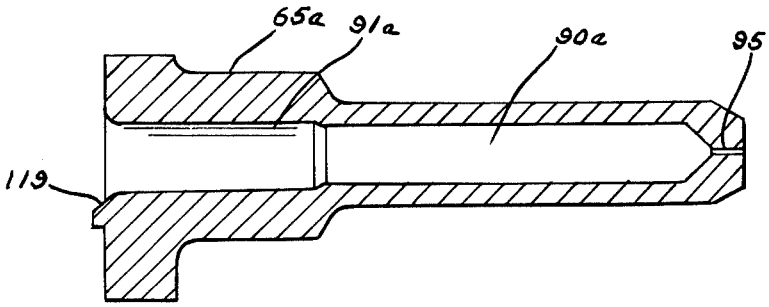
FIG. 17 is a longitudinal section view similar to FIG. 15 except of a chamber adapter for firing blank cartridges.
Figure 18:
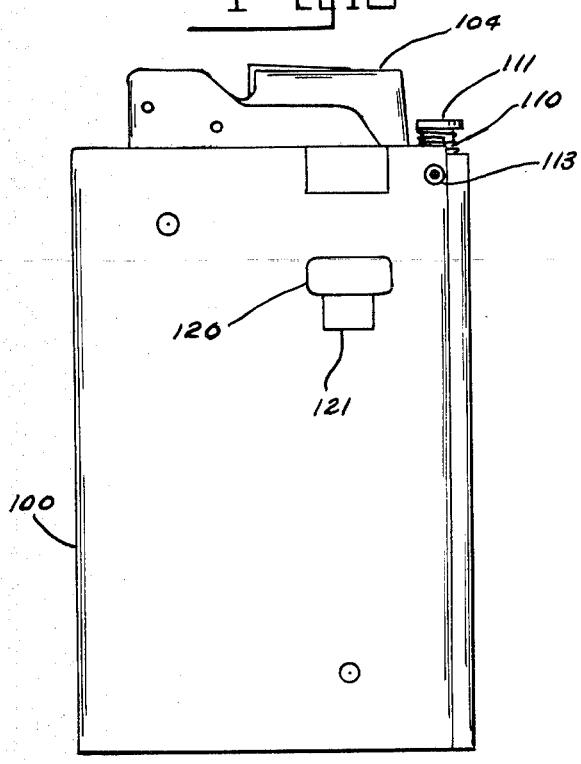
FIG. 18 is a pictorial left side view of a typical embodiment of a magazine adapter.

Commercially available prior art adapters do not have rifling in bore 90 of adapter chamber 65 ahead of low power cartridge case chamber 91 (FIG. 15). I have found that one of the primary causes of malfunctioning of prior art adapters is due to slow ignition, i.e., low initial burning rate of the powder not providing sufficient blow-back on the bolt to operate the action. I have also found that the primary reason for these low pressures on the bolt is caused by defective crimping of the case neck on the bullet allowing the bullet projectile to leave the case and start down the smooth bore passageway of the prior art adapters before complete ignition of the powder from the primer flash has taken place. The smooth bore of the prior art chambers necessarily is larger than the bullet diameter so it does not provide a sufficient seal to the bullet to hold back the gases and provide combustion pressure buildup. Thus, complete combustion of the powder either does not occur or else if it does, it occurs at a slower rate so normal blow-back pressures are never developed. While poor crimping of the case to the bullet is the primary cause of this type of malfunction, other causes such as poor or defective powder or primers, or mechanically damaged rounds, will also cause a low pressure initial powder burn due to the bullet leaving the case and the powder then burning substantially in an unconfined condition. The diameter of bore 90 of adapter chamber 65 cannot be made so small as to never be larger than the minimum tolerance diameter of the manufactured bullets to effect a seal because with bullets going to the large tolerance diameter and the bore going to the small end of its tolerance a severe interference fit between the bullet and the bore would occur with no place for the lead of the bullet to go other than through elongation of the bullet. This would cause extremely high pressures, be detrimental to the action and result in very inaccurate fire. I have found that by providing lands 92 and grooves 93, as shown in section in FIG. 16, in bore 90 of adapter chamber 65 ahead of rimfire case chamber 91, a simple efficient, and economical seal of the bore to the bullet is obtained. This seal provides for much better (higher and more uniform) pressure buildup with poor ammunition and a great decrease in the number of gun malfunctions, particularly with poor ammunition. It is not necessary that the lands and grooves in the bore of the adapter constitute rifling, i.e., have a twist or spiral. Neither is it necessary that the number of lands and grooves in the adapter be the same number as are in the barrel of the rifle, nor is any alignment of the lands and grooves of the adapter with those of the rifle barrel necessary. It is important to effect a good seal that the rifling engage the bullet before it completely leaves the cartridge case. I have found that optimally the length of the rimfire chamber 91 from the face of chamber 96 to the start of rifling 97 should be approximately $0.735 \pm 0.005$ for use with standard commercial makes of .22 caliber long rifle ammunition. This assures a seal by case expansion and the upsetting of the base of the bullet. If the lands and grooves in the adapter are in the form of rifling it is generally desirable that the twist be in the same direction as the rifling in the barrel and at approximately the same rate of twist. Generally, it is most economical to use the same tools and techniques in placing the lands and grooves in the adapter as the rifling in the gun barrel, hence, it is generally preferable to rifle the adapter similarly to that of the gun in which it is to be used. In many instances, it may be most feasible, economically, to fabricate an adapter chamber from a section of rifled barrel blank material. Typically, for rifles of the M16 type, six grooves, right hand one turn in approximately twelve inches, with the diameter across grooves approximately 0.2235±0.0010 and across lands 0.219±0.0010, and a groove arc of approximately 40° 30′, is suitable. In many instances, more uniform velocities may be obtained by using standard .22 caliber rimfire barrel rifling for adapter fabrication.

It is frequently desirable, particularly in military usage to fire blank cartridges in semiautomatic fire that are not as loud and more economical than blank cartridges of the size for which the gun was originally designed. By simply substituting adapter chamber 65*a* as shown in cross section in FIG. 17 in place of adapter chamber 65 blank rounds of ammunition of similar case design may be fired in the semiautomatic mode. The dimensions of orifice 95 are a function of the characteristics of the blank cartridge to be fired. Typically, for conventional .22 caliber rimfire blank cartridges, an orifice port 95 having a 0.062 inch diameter ±0.001 inch has been found to be suitable. For conventional 5.56 ram set cartridges (a nominal .22 caliber rimfire blank cartridge (expressed metrically) that is used in construction to drive nails), an orifice diameter of 0.092±0.001 inch opening has been found to be suitable. The length of tubular passage 95 is not critical. For other .22 caliber rimfire blank cartridges the diameter of the orifice is correspondingly increased or decreased in accordance with the powder charge contained. Generally, suitable lengths of passageway are approximately ⅛ inch. Obviously, the wall thickness at the end of the blank chamber adapter should be of sufficient thickness to withstand the pressures developed by the blank cartridge.

Figure 19:
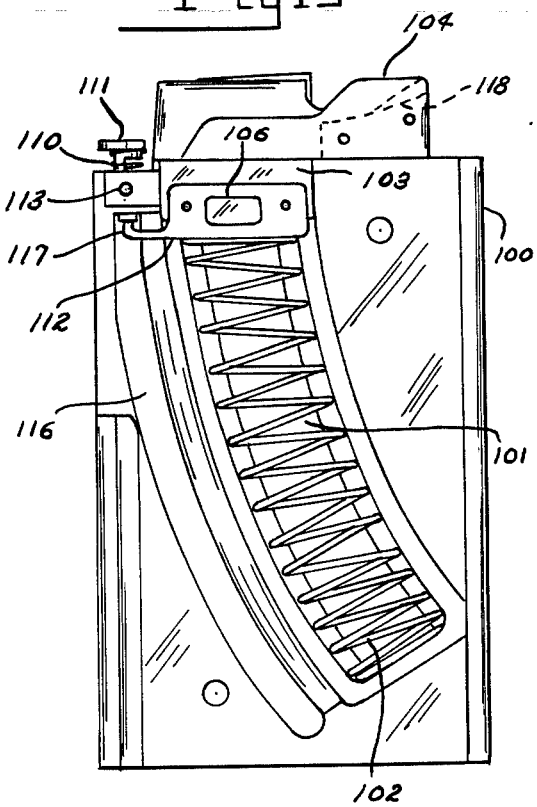
FIG. 19 is a right side view of the magazine of FIG. 18 with the cover removed.
Figure 20:
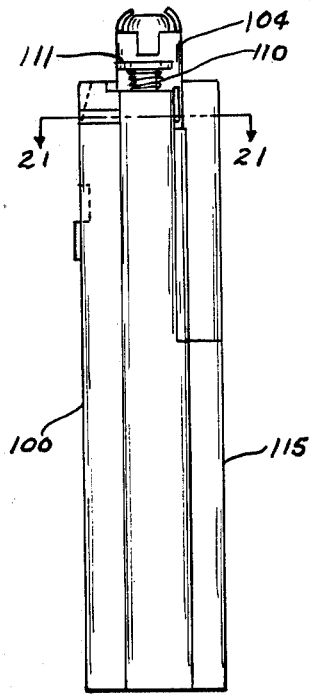
FIG. 20 is a rear view of the magazine of FIG. 18.
Figure 21:
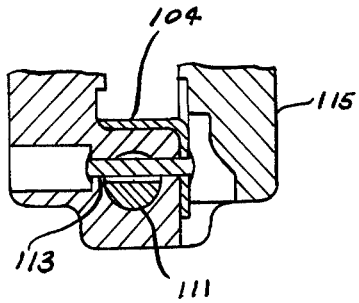
FIG. 21 is a partial section view through the retaining pin as shown in FIG. 20.
Figure 22:
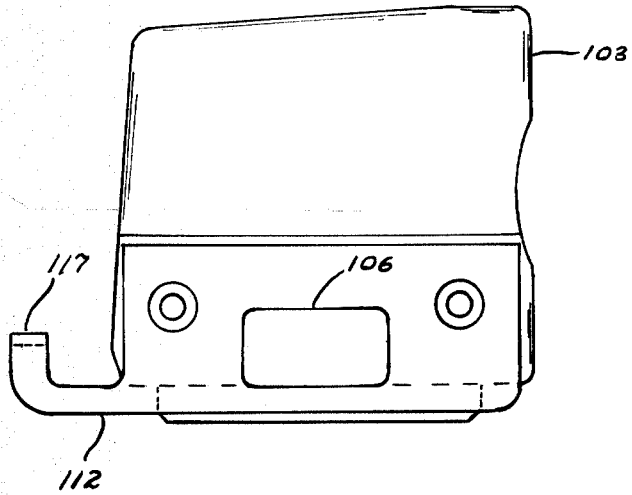
FIG. 22 is a view of an embodiment of a typical magazine follower for the embodiments of magazine as illustrated in FIGS. 18 through 21.
Figure 23:
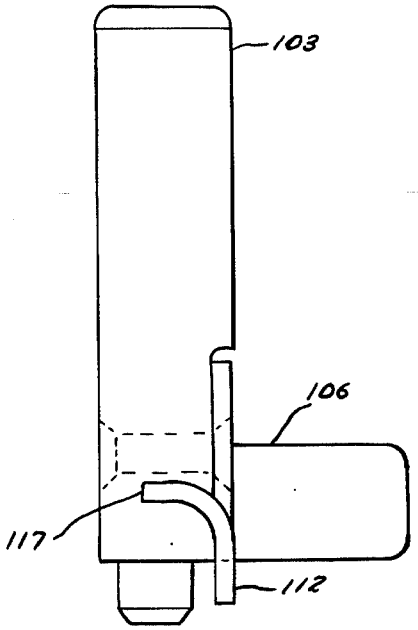
FIG. 23 is an enlarged left side view of FIG. 22.
Figure 24:
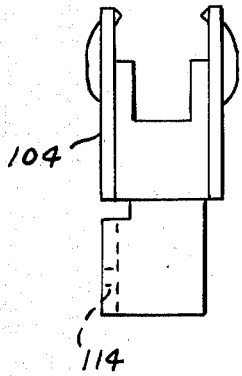
FIG. 24 is an enlarged pictorial front view of typical feed lips of the magazine.
Figure 25:
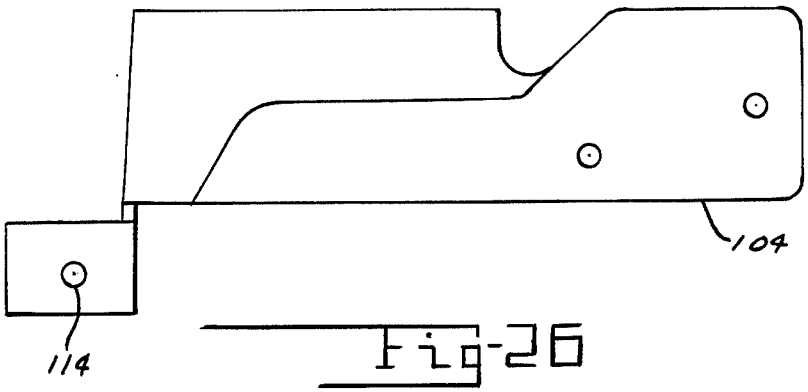
FIG. 25 is a right side view of typical magazine feed lips.
Figure 26:
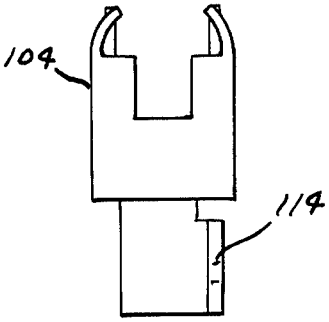
FIG. 26 is a rear view of typical magazine feed lips.

A typical embodiment of a magazine adapter cooperating with the just described bolt and chamber adapter for rifles of the M16 type is shown in detail in FIGS. 18 through 26, and in position in the gun in FIGS. 2 and 3. Magazine adapters for use with chamber and bolt adapters for converting the fire of a high powered rifle to lower power are well known. Typical prior art magazine adapters for converting the ammunition feed to a rifle from a caliber such as the .223 to .22 long rifle rimfire caliber are disclosed in the patents previously referenced. The embodiment of magazine adapter 100 as illustrated in FIGS. 2, 3, 18, 19, and 20 feeds the .22 caliber long rifle rimfire rounds through containing passageway 101 by spring (102) actuated follower 103 to conventionally designed feed lips 104. Protruding bolt feed lug 105 (FIGS. 7 and 10) on the bottom of bolt 52 engages the rear of the uppermost round 60 (FIG. 3) in the magazine as bolt 52 passes over magazine lips 104 returning to battery and chambering the round. The magazine adapter is manually loaded with .22 caliber rimfire cartridges in the conventional manner of feeding the cartridges, one at a time, through lips 104 with one hand while adapter 100 is held by the other hand with the thumb of that hand assisting in the compression of the follower spring 102 by pressing on protruding lug 106 of follower 103 (FIGS. 19 and 22).

When using the rifle in the conventional manner with standard .223 high power cartridges when the magazine is emptied and after the bolt has recoiled from firing the last round from the magazine, the magazine follower by it spring, pushes up on bolt catch lever 107 (FIGS. 2 and 3) and moves it so as to engage the returning bolt and hold it back, thus, automatically maintaining the action open after firing the last round. The prior art low power magazine adapters do not have this very desirable safety feature. When using the known prior art adapter systems the bolt can only be held back so as to maintain the action open by manually actuating bolt catch lever 107 from its protruding lug on the left side exterior receiver surface. In the prior art devices, after firing the last round from a magazine the bolt closes on an empty chamber, and the rifleman has no indication that the chamber is empty until he squeezes the trigger and the gun doesn't fire. In the disclosed invention, the bolt catch lever 107 is automatically actuated by the magazine adapter to hold the bolt back, and maintain the action open after the firing of the last round. This operation occurs through the unique cooperation of forces from magazine follower spring 102 and lifter spring 110 both pressing upwardly on bolt stop plunger 111 after the firing of the last round from the magazine and the magazine is empty.

It is to be observed that metallic guide 112, which is conventionally attached (such as riveted) to follower 103 (see FIGS. 19, 22, and 23) assists lifter spring 110 in actuating bolt step plunger 111 only when magazine 100 is empty. The combined forces of lifter spring 110 and magazine spring 102 pressing upwardly on plunger 111 are sufficient to move bolt catch lever 107 upward so that it engages the returning bolt and holds it back. Bolt catch lever 107 may also, of course, be manually operated from the left side of the receiver in the normal manner. Lifter spring 110 acting alone on plunger 111 must not be strong enough to move bolt catch lever 107. In this unique double spring arrangement magazine follower spring 102 is of normal strength for .22 rimfire ammunition. To fabricate a magazine adapter in which the magazine follower spring alone actuates bolt catch lever 107, i.e., a spring as strong as in the conventional high powered .223 caliber magazine, would require a spring too strong to permit proper feeding of .22 caliber rimfire cases. It would also increase the loading effort required to load the magazine. Rivet 113, acting in a cutout in shaft plunger 111, serves as a retaining stop for the plunger. In addition, rivet 113 aids in securing feed lips 104 to magazine body 100. In the view shown in FIG. 19 magazine cover plate 115 has been removed from magazine body 100 to show slot 116 in which lip 117 of guide 112 moves. The cover is in place in the views shown in FIGS. 2 and 3. Typical and suitable materials from which to fabricate magazine body 100, cover 115, and follower 103 is Delron or Celcon Acetal plastic. The feed lips are conventionally fabricated from steel and tempered to provide the desired spring action. Plunger 111 is conventionally machined from suitable tool steel. Conventional recess 120 and boss 121 cooperate with the conventional magazine latch in the receiver of the rifle.

Figure 27:
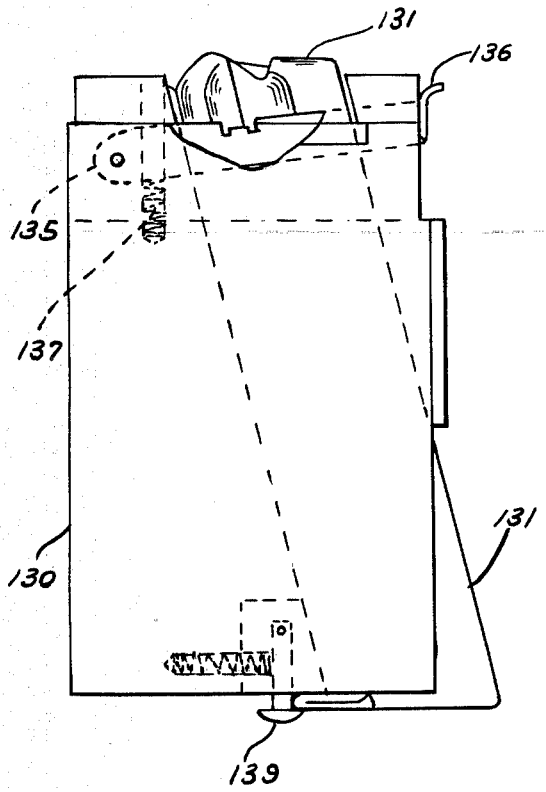
FIG. 27 illustrates another embodiment of a magazine adapter showing the cooperation with a conventional .22 caliber rimfire prior art magazine.
Figure 28:
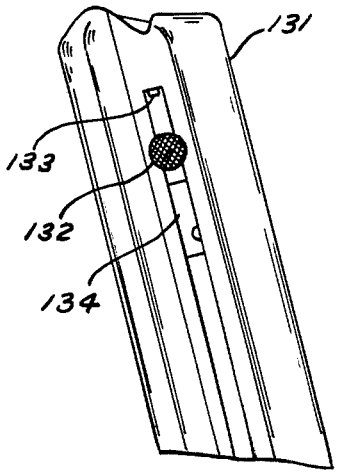
Fig-28 PRIOR ART
FIG. 28 illustrates a typical prior art .22 caliber rimfire magazine.
Figure 29:
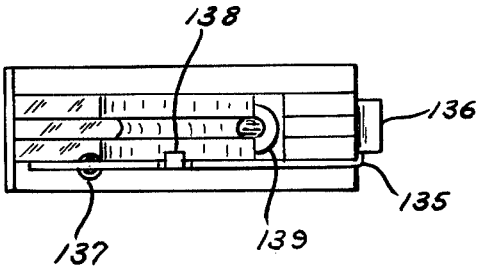
FIG. 29 is a top view looking down on the embodiment of the magazine adapter, (without the conventional .22 caliber rimfire magazine in place) illustrated in FIG. 27.

Another embodiment of an adapter magazine is illustrated in FIGS. 27 and 29. This embodiment is fabricated to cooperate with conventional unmodified, prior art commercially available .22 caliber long rifle rimfire magazines such as the Smith and Wesson Model 41 as illustrated in FIG. 28. Body 130 of the adapter is fabricated of similar material, and like the previously described embodiment, to be of substantially the same size and shape as the conventional .223 caliber magazine, so as to function with the rifle. Commercially available magazine 131 has thumb button 132 and slightly protruding actuating and stop lug 133 attached to magazine follower 134. Magazine adapter case 130 has a pivoted, spring loaded, steel lever arm 135 with bolt catch actuating lip 136. lip 136 moves rifle bolt catch 107 to hold the action open after firing the last round from the magazine. Lever assist lifter spring 137 acts in combination with the commercial magazine follower spring (not shown) in magazine 131 to overcome the spring force on the bolt catch in the gun, in a manner similar to the double spring action of the previously described magazine adapter. Protruding lug 133 of conventional prior art magazine follower 134 engages turned down lip 138 of actuating arm 135 only after the last round has been chambered from the magazine. Spring loaded magazine latch 139 holds prior art magazine 131 in adapter case 130 yet provides easy insertion and removal of magazine 131 for loading. As in the previously described embodiment of a magazine adapter, spring 137 should not be strong enough to trip the bolt catch yet strong enough so that when its force is combined with the force from the magazine follower spring the bolt catch lever will be actuated.

Figure 30:
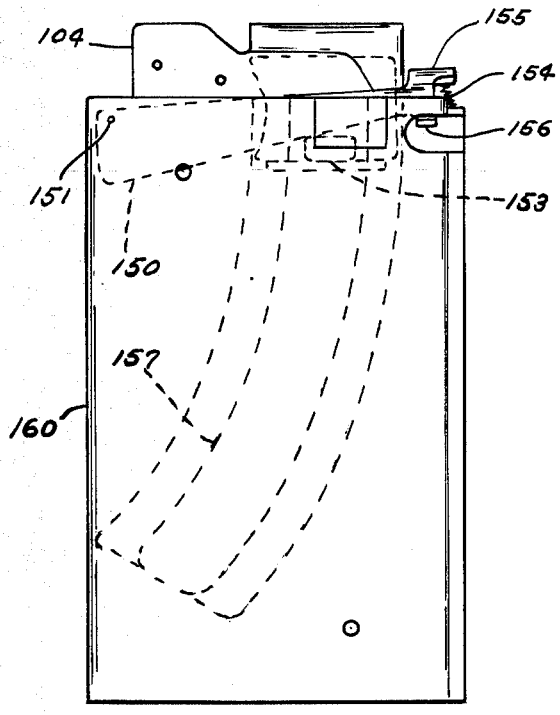
FIG. 30 is a left side view of another embodiment of a magazine adapter having a side actuated lever cooperating with the bolt catch.
Figure 31:
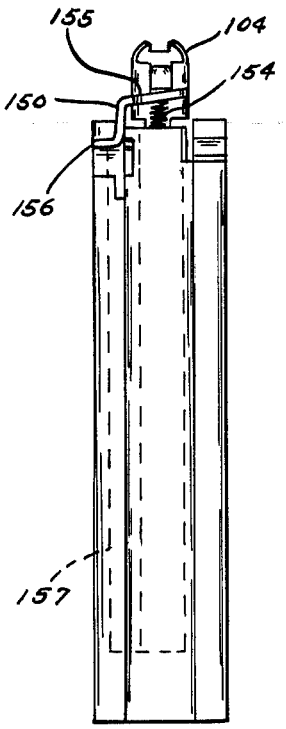
FIG. 31 is a rear view of the magazine illustrated in FIG. 30.
Figure 32:
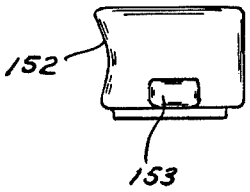
FIG. 32 is a left side view of the follower of the magazine illustrated in FIG. 30.

Another embodiment of a magazine adapter is illustrated in FIGS. 30 and 31. It is similar to the previously described magazine adapter, illustrated in FIGS. 18, 19, and 20, except for the bolt catch actuating mechanism. Metallic lever arm 150 is conventionally pivoted at 151. Magazine follower 152 has integrally molded lug 153 (opposite the thumb lug) which bears on lever arm 150 so that the follower spring (not shown) is coupled with the lever arm lifter spring 154 after the last round has left the magazine. Their combined force acting on lip 155 is sufficient to actuate the bolt catch of the gun. Outwardly turned lip 156 of lever arm 150 functions in cooperation with the cutout in the case side to provide a limit of travel stop for the movement of the arm. Recess 157 in case 160 provides clearance for the movement of actuating lug 153.

It is to be understood that while the magazine adapters illustrated herein are nominal ten-round magazine adapters, the invention is just as applicable to magazines of different cartridge capacity.

I claim:

1. An adapter system for converting a rifle normally utilizing high power rifle cartridges of a given projectile caliber to a rifle utilizing low power cartridges of the same projectile caliber, the said rifle having a high power cartridge chamber; a gas tube; a receiver having a lower receiver extension socket, a magazine latch, and a bolt catch; the said adapter system comprising:

a. A low power cartridge bolt and chamber adapter assembly insertable in the said rifle receiver and high power cartridge chamber, the said bolt and chamber adapter assembly having a rear retainer, guide rails with the said bolt slidably positioned thereon, a cartridge rim receiving face on the said bolt, and the said chamber attached in flexible relationship to the said guide rails;

b. a forward locator pivotably attached in spring loaded relationship to the said rear retainer of the said adapter assembly cooperating with the said rifle lower extension socket to maintain the said chamber adapter seated in the said rifle high power cartridge chamber;

c. a gas diverter attached to the said adapter bolt cooperating with the said rifle gas tube for diverting powder gases and residue outside the said receiver;

d. means for providing a sealing relationship between the said projectile of the said low power cartridge and the said adapter chamber;

e. a cartridge case rim retainer having an undercut recess positioned on the said adapter bolt face;

f. an adapter magazine for feeding the said low power cartridges into the receiver, removably attachable to the said rifle receiver by the said magazine latch, the said magazine adapter having a follower spring and a lifter spring; and g. means for coupling the said follower spring to the said lifter spring only when the said adapter magazine is empty of cartridges, the said means cooperating with the said rifle bolt catch to hold the said adapter bolt in the open position after firing the last cartridge from the said adapter magazine.

2. The adapter system as claimed in claim 1 wherein the said means for providing a sealing relationship between the said projectiles and the said chamber adapter includes lands and grooves.

3. The adapter system as claimed in claim 2 wherein the said lands and grooves are rifling.

4. The adapter system as claimed in claim 1 wherein the said undercut recess in the said rim retainer is undercut at an angle of approximately twenty degrees to a perpendicular to the said bolt face.

5. The improvement in a rifle adapter system for adapting a rifle designed to normally fire a high power cartridge of a given caliber projectile to fire a low power cartridge of the same caliber projectile, the said rifle having a high power cartridge chamber, a receiver, a gas tube, a lower receiver extension socket, and a bolt catch; and the said adapter system having an adapter magazine with a follower spring for feeding the said low power cartridges into the said rifle chamber, and a low power cartridge adapter bolt slidably positioned on guide rails positioned in a rear retainer, the said adapter bolt having a bolt face with a recessed cartridge rim retainer, the said improvement in the adapter system comprising:

a. means for coupling the said adapter chamber to the said guide rails in flexible relationship;

b. a forward locator pivotably attached to the said rear retainer in spring loaded relationship;

c. a gas diverter tube cooperating with the said rifle gas tube and having a port for expelling gases and residue out of the said receiver in a transverse downward direction from the bolt;

d. an undercut of approximately twenty degrees positioned in the said recessed cartridge rim retainer;

e. means for establishing a sealing relationship between the said low power cartridge projectile and the said adapter chamber;

f. means including a lifter spring attached to the said adapter magazine for cooperating with the said rifle bolt catch; and g. means for combining the spring forces of the said magazine follower spring and the said lifter spring only when the said adapter magazine is empty.

6. The improvement as claimed in claim 5 wherein the said means for establishing a sealing relationship includes lands and grooves.

7. The improvement in a rifle adapter system for adapting a rifle designed to normally fire a high power cartridge of a given caliber projectile to fire a low power cartridge of the same caliber projectile, the said rifle having a high power cartridge chamber, a receiver, and a lower receiver extension socket; the said adapter system having a low power chamber adapter, and a low power cartridge adapter bolt slidably positioned on guide rails positioned in a rear retainer, the said improvement in the adapter system comprising:

means for coupling the said low power adapter chamber to the said guide rails in flexible relationship, providing a seating of the said low power adapter chamber in the said rifle high power cartridge chamber.

8. The improvement in a rifle adapter system for adapting a rifle designed to normally fire a high power cartridge of a given caliber projectile to fire a low power cartridge of the same caliber projectile, the said rifle having a high power cartridge chamber, a receiver, and a lower receiver extension socket; the said adapter system having a low power chamber adapter, and a low power cartridge adapter bolt slidably positioned on guide rails positioned in a rear retainer, the said improvement in the adapter system comprising:

a forward locator pivotably attached in spring loaded relationship to the said rear retainer of the said adapter assembly cooperating with the said rifle lower extension socket to maintain the said low power chamber adapter seated in the said rifle high power cartridge chamber.

9. The improvement in a rifle adapter system for adapting a rifle designed to normally fire a high power cartridge of a given caliber projectile to fire a low power cartridge of the same caliber projectile, the said rifle having a high power cartridge chamber, a receiver, and a lower receiver extension socket; the said adapter system having a low power chamber adapter, and a low power cartridge adapter bolt slidably positioned on guide rails positioned in a rear retainer, the said improvement in the adapter system comprising:

a. means for coupling the said low power adapter chamber to the said guide rails in flexible relationship, providing a seating of the said low power adapter chamber in the said rifle high power cartridge chamber; and b. a forward locator pivotably attached in spring loaded relationship to the said rear retainer of the said adapter assembly cooperating with the said rifle lower extension socket to maintain the said low power chamber adapter seated in the said rifle high power cartridge chamber.

10. The improvement in a rifle adapter system for adapting a rifle designed to normally fire a high power cartridge of a given caliber projectile to fire a low power cartridge of the same caliber projectile, the said rifle having a high power cartridge chamber, a receiver, and a lower receiver extension socket; the said adapter system having a low power chamber adapter, and a low power cartridge adapter bolt slidably positioned on guide rails positioned in a rear retainer, the said improvement in the adapter system comprising: means, including a spring, cooperating with the said rear retainer of the said adapter assembly and the said rifle lower extension socket to maintain the said low power chamber adapter seated in the said rifle high power cartridge chamber.

11. In an adapter for converting a firearm adapted for automatic feed of ammunition to use different size ammunition, the firearm having a firearm receiver with a first and a second end and a firearm barrel extending from the second end, the adapter having a fixed adapter receiver with a first portion located at the first end of the firearm receiver and a barrel insert at the second end of the firearm receiver, the barrel insert extending into the firearm barrel, the first portion of the adapter receiver and its barrel insert having a connection therebetween, the improvement comprising:

a resilient spring mounted on the adapter receiver facing the first end of the firearm receiver biasing the adapter receiver away from the first end of the firearm receiver.

12. The adapter of claim 11 wherein there is further included:

connection means for loosely pinning the barrel insert to the adapter receiver for permitting the barrel insert to center in the firearm barrel.

13. The adapter of claim 12 wherein said connection means includes:

a rail on the adapter receiver having a hole therethrough; the barrel insert having a groove therein sized to receive said rail and having a hole therethrough;

a pin fitting through said holes with the pin having a tight fit with the barrel insert and a loose fit with said rail.

14. In an adapter for converting an at least partially automatic firearm to use different size ammunition, said firearm having a firearm chamber, a firing mechanism and a housing for containing the firing mechanism of said firearm, the adapter having a barrel insert for being positioned in the breech end of the firearm chamber and a fixed receiver connected to said barrel insert for being positioned behind the barrel insert with respect to the chamber, and the firearm having a cartridge ejector slot at one side of the housing, the improvement comprising: a single side rail connected to the barrel insert and to the receiver on the external sides of the barrel insert and the receiver located away from the cartridge ejector slot, said single side rail being located with its outward side exposed to the exterior of the adapter and being a fixed connection between the receiver and the barrel insert with respect to their longitudinal separation, said side rail being separable from the barrel insert, the barrel insert being loosely pinned to said rail allowing pivotal movement of the barrel insert about the longitudinal axis of the adapter.

15. The improvement of claim 14 wherein said side rail is a flat bar.

* * * * *